US008895491B2

(12) United States Patent
Vinson et al.

(10) Patent No.: US 8,895,491 B2
(45) Date of Patent: Nov. 25, 2014

(54) CONCENTRATED CLEANING COMPOSITIONS AND THEIR USE

(71) Applicant: Ecolab USA Inc., St. Paul, MN (US)

(72) Inventors: Thomas John Vinson, Thomasville, NC (US); Melissa Collazo-Martinez, Greensboro, NC (US)

(73) Assignee: Ecolab USA Inc., St. Paul, MN (US)

( * ) Notice: Subject to any disclaimer, the term of this patent is extended or adjusted under 35 U.S.C. 154(b) by 59 days.

(21) Appl. No.: 13/716,633

(22) Filed: Dec. 17, 2012

(65) Prior Publication Data

US 2013/0184192 A1 Jul. 18, 2013

Related U.S. Application Data

(60) Provisional application No. 61/587,036, filed on Jan. 16, 2012.

(51) Int. Cl.
*C11D 3/20* (2006.01)
*C11D 11/00* (2006.01)

(52) U.S. Cl.
CPC ..... *C11D 3/2082* (2013.01); *C11D 3/2075* (2013.01); *C11D 3/2079* (2013.01); *C11D 3/2086* (2013.01); *C11D 11/0023* (2013.01)
USPC ..... 510/214

(58) Field of Classification Search
USPC ..... 510/214
See application file for complete search history.

(56) References Cited

U.S. PATENT DOCUMENTS

| | | | | |
|---|---|---|---|---|
| 4,749,508 | A * | 6/1988 | Cockrell et al. | 510/201 |
| 4,877,459 | A * | 10/1989 | Cockrell et al. | 134/40 |
| 2003/0034050 | A1 * | 2/2003 | Policicchio et al. | 134/6 |
| 2004/0001797 | A1 * | 1/2004 | Saud et al. | 424/70.16 |
| 2011/0079246 | A1 * | 4/2011 | Collazo-Martinez et al. | 134/6 |
| 2011/0237481 | A1 * | 9/2011 | Vinson et al. | 510/197 |
| 2012/0165240 | A1 * | 6/2012 | Finison et al. | 510/365 |

* cited by examiner

*Primary Examiner* — Nicole M Buie-Hatcher
*Assistant Examiner* — M. Reza Asdjodi
(74) *Attorney, Agent, or Firm* — Merchant & Gould P.C.

(57) ABSTRACT

The present disclosure relates to a concentrated acidic floor cleaner and methods of using it to clean floors. The concentrated acidic floor cleaner can be diluted to form a use solution that is effective at removing polymerized grease, including animal and vegetable fats and non-trans fats, and other soils from floors. The use solution is especially useful for cleaning floors in commercial kitchens of full service and quick service restaurants and is effective on a variety of floors, including quarry tile.

15 Claims, No Drawings

CONCENTRATED CLEANING COMPOSITIONS AND THEIR USE

CROSS-REFERENCE TO RELATED APPLICATION

This application claims the benefit of U.S. Provisional Application No. 61/587,036, filed Jan. 16, 2012, entitled "Super Concentrated Floor Cleaner Compositions and Their Use," which is incorporated by reference herein in its entirety.

BACKGROUND

Cooking soils such as airborne grease deposit on kitchen surfaces in commercial kitchens. This is particularly problematic with animal or vegetable fats, including non-trans fats. During cooking, animal or vegetable fats become airborne and deposit on surfaces including floors. When the fat contacts the air, it polymerizes and forms an invisible layer of soil on surfaces including floors. The polymerized fat soil on floors is undesirable as both unclean and unsafe. It is against this background that the present disclosure is made.

SUMMARY

The present disclosure generally relates to acidic floor cleaners that are effective at removing polymerized soils from floors. In some embodiments, the floor cleaners are made by diluting a concentrated acidic floor cleaner with water to form a use solution. Concentrated compositions are desirable, particularly for small kitchens or restaurants that have limited storage space for storing cleaning products as they take up less space but last as long as less concentrated products.

Accordingly, in some aspects, the present disclosure relates to a method of cleaning floors by forming a use solution by mixing water and from about 1 to about 0.5 ounces per gallon of water of a concentrated acidic floor cleaner, the concentrated acidic floor cleaner comprising an acid wherein the concentrated acidic floor cleaner has ratio of total acid to free acid of at least 5:1, at least 3:1, or at least 2.5:1. Once the use solution is made, it can be applied to floors to remove the polymerized soils.

These and other embodiments will be apparent to those skilled in the art and others in view of the following detailed description of some embodiments. It should be understood that this summary and the detailed description illustrate only some examples of various embodiments and are not intended to be limiting to the claimed invention.

DETAILED DESCRIPTION

The present disclosure relates to a concentrated acidic floor cleaner and methods of using it to clean floors. The concentrated acidic floor cleaner can be diluted to form a use solution that is effective at removing polymerized grease, including animal and vegetable fats and non-trans fats, and other soils from floors. The use solution is especially useful for cleaning floors in commercial kitchens of full service and quick service restaurants and is effective on a variety of floors, including quarry tile and concrete. A concentrate refers to a product that is diluted to form a use solution before it is applied to a surface. A use solution refers to a product that is applied to a surface.

The concentrated acidic floor cleaner is advantageous because less chemistry is required in order to prepare a use solution. This means that less product needs to be shipped to and stored at a location. In some embodiments, the concentrated acidic floor cleaner can be diluted with water in dilutions of from about 1 to about 0.1 ounces per gallon of water, from about 0.5 to about 0.1 ounces per gallon of water, or from about 0.5 to about 0.25 ounces per gallon of water. In some embodiments, the concentrated acidic floor cleaner is substantially free of any added water (excluding water associated with the raw materials). In some embodiments, the concentrated acidic floor cleaner is free of any added water (excluding water associated with the raw materials). In some embodiments, the concentrated acidic floor cleaner is free of hydrofluoric acid, which can be damaging to floors. The concentrated acidic floor cleaner preferably creates a use solution having a pH from about 1 to about 6, about 2 to about 5, or about 2 to about 4.

In some embodiments, the concentrated acidic floor cleaner is formulated especially to be less irritating to eyes and skin, both as a concentrate, and as a use solution. For example, raw materials can be selected to be less irritating. It is understood, however, that the composition can be concentrated to a point where the concentrate may be irritating, but the use solution would not be considered irritating to the eyes and skin. Exemplary formulations for the concentrated acidic floor cleaner include the following:

TABLE A

Exemplary Formulations

| Raw Material | Concentration | | |
|---|---|---|---|
| first acid | 5-50 | 10-40 | 15-25 |
| second acid | 5-25 | 8-22 | 10-20 |
| surfactant | 0.25-6 | 0.5-4 | 1-5 |
| buffer | 0.25-6 | 0.5-4 | 1-5 |
| optional amine | 2-12 | 4-8 | 6-10 |
| hydrotrope | 0-6 | 0.5-4 | 1-3 |
| water | balance | balance | balance |

In some embodiments, the concentrated acidic floor cleaner can consist of a first acid, an amine, and a buffer. The concentrated acidic floor cleaner can be formulated as a solid block, powder, granulate, pellet, liquid, thickened liquid or gel, or emulsion. In some embodiments, it may be desirable to dispense the product as a foam. In these embodiments, the foam can be generated chemically by including foaming agents and foaming surfactants into the formulation. The foam can also be generated mechanically or a combination of mechanical and chemical foam generation. In some embodiments, when the concentrated acidic floor cleaner is formulated as a thickened liquid or gel, it has been found that an amine and an anionic surfactant contribute to the stability of the thickened product. More specifically, the concentration of free amine is preferably less than 0.1 wt. %, less than 0.05 wt. %, or the composition should contain zero free amine. A preferred combination of anionic surfactant and amine is dodecyl benzene sulfonic acid (DDBSA) and triethanolamine (TEA), although other surfactant/amine combinations can be used. The preferred ratio of DDBSA:TEA is 2.2:1. When the concentrated acidic floor cleaner is formulated as a thickened liquid, the viscosity is preferably from about 125 to about 900 centipoise, from about 125 to about 600 centipoise, or from about 125 to about 300 centipoise when measured using a Brookfield viscometer using spindle #21 at an RPM of 30 and a temperature of 72° F. If necessary, the viscosity can be lowered using propylene glycol, which has been found to have thinning properties when included in the concentrate composition from about 1 to about 5 wt. %.

Acid

The concentrated acidic floor cleaner includes at least one acid. The acid is preferably selected from the group consisting of citric, isocitric, tartaric, malic, monohydroxyacetic, acetic, and gluconic acid, and mixtures and salts thereof. But, any acid may be used including organic and inorganic acids. Exemplary inorganic acids include phosphoric, phosphoric, sulfuric, sulfamic, methylsulfamic, hydrochloric, hydrobromic, hydrofluoric, and nitric. In some embodiments, the acid is not hydrofluoric acid. Exemplary organic acids include hydroxyacetic (glycolic), citric, lactic, formic, acetic, propionic, butyric, valeric, caproic, gluconic, itaconic, trichloroacetic, urea hydrochloride, and benzoic. Organic dicarboxylic acids can also be used such as oxalic, maleic, fumaric, adipic, and terephthalic acid. Peracids such as peroxyacetic acid and peroxyoctanoic acid may also be used. Any combination of these acids may also be used.

In some embodiments, the acid has a pK value greater than about 2.8, about 3, or about 3.5. The concentration of the acid in the use solution is preferably sufficient to create a use solution pH from about 1 to about 6, from about 2 to about 5, or from about 2 to about 4. In some embodiments, the concentrated acidic floor cleaner has lower levels of free acid. While not wanting to be bound by theory, it is believed that the formulations with more reacted acid than free acid are better cleaners. Accordingly, in some embodiments, the concentrated acidic floor cleaner has a ratio of total acid to free acid of at least about 2.5:1, at least about 2.0:1, or at least about 1.5:1.

Buffer

The concentrated acidic floor cleaner may optionally include a buffer. Exemplary buffers include phosphates, carbonates, amines, bicarbonates, and citrates. Exemplary phosphates include anhydrous mono-, di-, or trisodium phosphate, sodium tripolyphosphate, tetrasodium pyrophosphate and tetrapotassium pyrophosphate. Exemplary carbonates include sodium carbonate, potassium carbonate, and sesquicarbonate. Exemplary citrates include sodium or potassium citrate. Exemplary amines include urea and morpholine.

Hydrotrope

The concentrated acidic floor cleaner may optionally include a hydrotrope that aids in compositional stability, and aqueous formulation. Functionally speaking, the suitable couplers which can be employed are non-toxic and retain the active ingredients in aqueous solution throughout the temperature range and concentration to which a concentrate or any use solution is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl) and $C_8$-$C_{10}$ alkyl glucosides. Preferred coupling agents include n-octanesulfonate, available as NAS 8D from Ecolab Inc., n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co- or -terpolymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides. In some embodiments, the hydrotrope is selected from the group consisting of sodium alkylnaphthalene sulfonate, sodium xylene sulfonate, and mixtures thereof.

Surfactant

The concentrated acidic floor cleaner can optionally include a surfactant. The surfactant or surfactant mixture can be selected from water soluble or water dispersible nonionic, semi-polar nonionic, anionic, cationic, amphoteric, or zwitterionic surface-active agents, or any combination thereof. The surfactant is preferably nonionic, anionic, or amphoteric.

A typical listing of the classes and species of useful surfactants appears in U.S. Pat. No. 3,664,961 issued May 23, 1972, to Norris.

Nonionic Surfactants

Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactants are available under the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols can be used. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

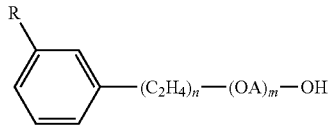

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $YR[C_3H_6O_n(C_2H_4O)_mH]_x$ wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional useful conjugated polyoxyalkylene surface-active agents correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; $R^2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from 0 to 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or $—(C_2H_4O)_xH$, where x is in the range of from 1 to 3.

13. A useful class of nonionic surfactants includes the class defined as alkoxylated amines or, most particularly, alcohol alkoxylated/aminated/alkoxylated surfactants. These nonionic surfactants may be at least in part represented by the general formulae:

$$R^{20}—(PO)_sN\text{-}(EO)_tH,$$

$$R^{20}—(PO)_sN\text{-}(EO)_tH(EO)_tH, \text{ and}$$

$$R^{20}—N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, and t is 1-10, preferably 2-5. Other variations on the scope of these compounds may be represented by the alternative formula:

$$R^{20}—(PO)_v—N[(EO)_wH][(EO)_zH]$$

in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 amine alkoxylate.

The treatise Nonionic Surfactants, edited by Schick, M. J., Vol. 1 of the Surfactant Science Series, Marcel Dekker, Inc., New York, 1983 is a reference on the wide variety of nonionic compounds. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of useful nonionic surfactants. The semi-polar nonionic surfactants include the amine oxides, phosphine oxides, sulfoxides and their alkoxylated derivatives.

14. Amine oxides are tertiary amine oxides corresponding to the general formula:

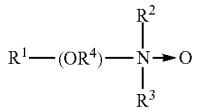

wherein the arrow is a conventional representation of a semi-polar bond; and $R^1$, $R^2$, and $R^3$ may be aliphatic, aromatic, heterocyclic, alicyclic, or combinations thereof. Generally, for amine oxides of detergent interest, $R^1$ is an alkyl radical of from 8 to 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to 20.

Useful water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

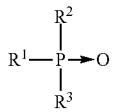

wherein the arrow is a conventional representation of a semi-polar bond; and $R^1$ is an alkyl, alkenyl or hydroxyalkyl moiety ranging from 10 to 24 carbon atoms in chain length; and $R^2$ and $R^3$ are each alkyl moieties separately selected from alkyl or hydroxyalkyl groups containing 1 to 3 carbon atoms.

Examples of phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants also include the water soluble sulfoxide compounds which have the structure:

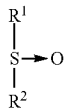

wherein the arrow is a conventional representation of a semi-polar bond; and, $R^1$ is an alkyl or hydroxyalkyl moiety of 8 to 28 carbon atoms, from 0 to 5 ether linkages and from 0 to 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Anionic Surfactants

Anionic surfactants are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore favored additions to heavy duty detergent compositions. Anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl)glucamine sulfates, and sulfates of alkylpolysaccharides such as the sulfates of alkylpolyglucoside (the nonionic nonsulfated compounds being described herein). A preferred example is sodium lauryl sulfate.

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants include the alkyl ethoxy carboxylates, the alkyl polyethoxy polycarboxylate surfactants and the soaps (e.g. alkyl carboxyls). Secondary soap surfactants (e.g. alkyl carboxyl surfactants) include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic surfactants include olefin sulfonates, such as long chain alkene sulfonates, long chain hydroxyalkane sulfonates or mixtures of alkenesulfonates and hydroxyalkanesulfonates. Also included are the alkyl sulfates, alkyl poly(ethyleneoxy)ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure $R_{11}X^+Y^-$— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

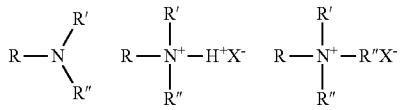

in which, R represents a long alkyl chain, R', R", and R"' may be either long alkyl chains or smaller alkyl or aryl groups or hydrogen and X represents an anion. The amine salts and quaternary ammonium compounds are preferred for their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Useful cationic surfactants include those having the formula $R^1{}_mR^2{}_xYLZ$ wherein each $R^1$ is an organic group containing a straight or branched alkyl or alkenyl group optionally substituted with up to three phenyl or hydroxy groups and optionally interrupted by up to four of the following structures:

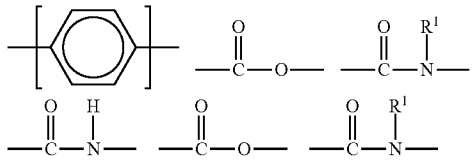

-continued

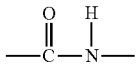

or an isomer or mixture of these structures, and which contains from 8 to 22 carbon atoms. The $R^1$ groups can additionally contain up to 12 ethoxy groups and m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y can be a group including, but not limited to:

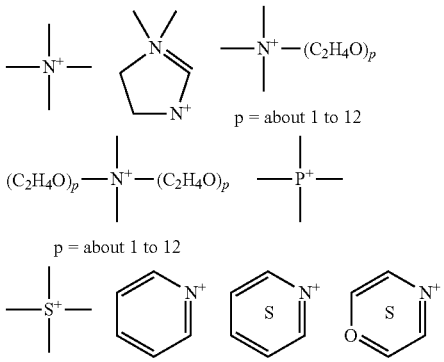

or a mixture thereof.

Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxyalkyl groups react to form a tertiary amine and an ether linkage with differing alkylating agents yielding different tertiary amines.

Long chain imidazole derivatives generally have the general formula:

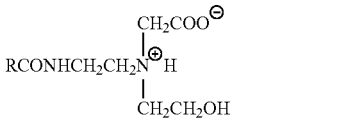

(MONO)ACETATE

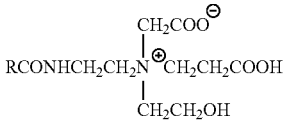

(DI)PROPIONATE

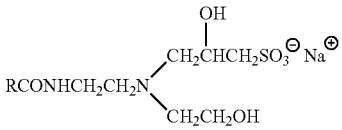

Neutral pH-Zwitterion

AMPHOTERIC SULFONATE wherein R is an acyclic hydrophobic group containing from 8 to 18 carbon atoms and M is a cation to neutralize the charge of the anion, generally sodium. Commercially prominent imidazoline-derived amphoterics include for example: cocoamphopropionate, cocoamphocarboxy-propionate, cocoamphoglycinate, cocoamphocarboxy-glycinate, cocoamphopropyl-sulfonate, and cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R is a $C_8$-$C_{18}$ straight or branched chain alkyl, fatty amine with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

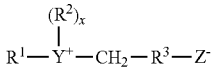

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-5-hexadecylsulfonio]-3-hydroxypentane-1-sulfate; 3-[P,P-diethyl-P-3,6,9-trioxatetracosanephosphonio]-2-hydroxypropane 1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N, N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxypentane-1-sulfate. The alkyl groups contained in said detergent surfactants can be straight or branched and saturated or unsaturated.

The zwitterionic surfactants include betaines of the general structure:

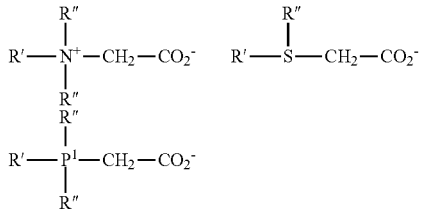

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Amines

The composition can optionally include an amine. Examples of suitable amines include alkyl amines, which may be primary, secondary, or tertiary or alkanolamines such as monoethanolamine, diethanolamine, and triethanolamine, or cyclic amines such as morpholine. Another suitable amine includes 2-amino-2-methyl-1-propanol (AMP). As discussed above, the amines have been found to help stabilize thickened versions of the disclosed compositions. This is also true when the amine is used together with an anionic surfactant. It has also be found that the amine is helpful at stabilizing a thickened product when the amount of free amine is reduced. In some embodiments, the disclosed compositions do not include any free amine. In some embodiments, the concentration of free amine in the concentrated formula is less than 0.1 wt. % or less than 0.05 wt. %. The amount of free amine may be reduced by reacting the amine with caustic.

Additional Materials

The concentrated cleaner can include one or more additional materials to provide desired properties or functionality. For example, the composition can include chelating or sequestering agents, sanitizers or antimicrobial agents, builders or fillers, dyes, odorants or perfumes, preservatives, processing aids, corrosion inhibitors, fillers, solidifying agents, hardening agents, foaming agents, and combinations of these materials.

Exemplary foaming agents include foaming surfactants such as alcohol ethoxylates, alcohol ethoxylate carboxylates, amine oxides, alkyl sulfates, alkyl ether sulfates, sulfonates, quaternary ammonium compounds, alkyl sarcosines, betaines, and alkyl amines.

Methods of Use

The concentrated acidic floor cleaner is diluted with water to form a use solution to be applied to a floor. The use solution can be used to clean a variety of floors including quarry tile, stone floors, and concrete. The use solution can be used in a variety of containers including buckets, sinks, or automatic floor scrubbing or polishing machines. The use solution can be applied to the floor using a variety of materials including a string mop, a flat mop, or an automatic scrubber or polisher. It can also be wiped on by hand or sprayed onto the floor. In some embodiments, the use solution is applied to the floor daily.

While the disclosed composition has been described as a floor cleaner, it is understood that the composition could be used for other applications. For example, the compositions can be used to treat other surfaces in restaurants, such as counters and food preparation equipment, that become soiled with the same polymerized fats that build up on floors. The compositions can be used to clean equipment, floors, and other hard surfaces in applications such as restaurants and restrooms. The compositions can be used to clean food and beverage processing plants and food and beverage processing equipment, such as equipment that is used to make cooking fats such as animal and vegetable based fats and oils and non-trans fats. The compositions can also be used to clean healthcare facilities such as hospitals, clinics, and long-term care facilities.

For a more complete understanding of the disclosure, the following examples are given to illustrate some embodiments. These examples and experiments are illustrative and not limiting.

EXAMPLES

Example 1

Example 1 determined the degreasing capability of two experimental formulas on quarry tile soiled with fresh palm oil. For this example, the following experimental concentrate formulas were used:

TABLE B

| Experimental Formula | | |
|---|---|---|
| Raw Material | Formula 1 Weight Percent | Formula 2 Weight Percent |
| Water Zeolite Softened | 58.95 | 19 |
| Dodecyl Benz Sulfonic Acid 96% | 14.26 | 30 |
| Citric Acid 50% | 11.40 | 18 |
| Triethanolamine 99% | 6.45 | 10 |
| NaOH 50% | 2.10 | 3.3 |
| Alcohol Ethoxylate | 2.90 | 5.8 |
| Propylene Glycol | 0.83 | 5.6 |
| Sodium Xylene Sulfonate 40% | 3.00 | 4.5 |
| Herbal Fragrance | 0.10 | 0.10 |
| Dye Bright Green LX-6545 | 0.0012 | 0.0012 |

For this experiment, five clean 3×3 vinyl composite tiles were weighed for each formula to determine their initial weight. Fresh palm oil was applied to each tile, leaving a ¼ to ½ inch perimeter around the soil, and the tiles were reweighed. Formula 1 was diluted to 0.5 ounces per gallon of water. Formula 2 was diluted to 0.25 ounces per gallon of water. The tiles were placed in the bottom of a container and the diluted cleaning solution was poured into the container to cover the by at least ⅛ of an inch. The tiles were allowed to sit in the diluted cleaning solution for 10 minutes. After 10 minutes, the tiles were removed from the cleaning solution and rinsed by immersing the tile into a clean beaker of water for 2 seconds. Excess water was allowed to drain off of the and the tiles were allowed to air dry. Once dry, the tiles were re-weighed. The percent soil removal was calculated using the following formula:

Final Substrate wt after clean(g) − Initial Substrate wt(g) = Residual soil wt(g)

$$100 - \frac{[\text{Residual soil wt(g)}]}{[\text{Starting soil weight(g)} \times 100]} = \%\ \text{Soil Removal}$$

where the starting soil weight in grams was determined by weighing clean tile and weight the tile with the soil on it and the calculating the difference between the weight of the soiled tile and the clean tile.

The % Soil Removal for the five tiles was averaged for each formula. Formula 1 had a % Soil Removal of 41% and Formula 2 had a % Soil Removal of 63%. Water was used as a control and had an average % Soil Removal of 0.

Example 2

Example 2 determined the degreasing capability of Formula 1 and Formula 2 in Table B compared to water on quarry tile soiled with non-trans fat oil used in the United States. Use solutions of Formula 1 and 2 were prepared as in Example 1. Test tiles were prepared as described in Example 1. Water removed 19% of the soil, the Formula 1 use solution removed 30% of the soil and the Formula 2 use solution removed 32% of the soil.

Example 3

Example 3 compared the results of the use solution of Formula 1 described in Example 1 in Table B and a use solution of 0.5 ounces per gallon of water of Kadet Quarry Tile Floor Cleaner, commercially available from Ecolab Inc., in an abrasion test. The purpose of the abrasion test was to simulate the mechanical action associated with mopping when the formulations are applied to the floor.

For this test, the rough backside of white 3×3 inch vinyl tiles were used as the substrate. Eight tiles for each test solution were prepared—four with a black soil and four with a red soil. The black soil is a mixture of 50 grams of mineral spirits, 5 grams of mineral oil, 5 grams of 10/30 W motor oil, 2.5 grams of oil dag (graphite lubricant), and 37.50 grams of bandy black clay. The red soil is a mixture of 30 grams of lard, 30 grams of 100% corn oil, 15 grams of whole dried egg, and 1.5 grams of iron III oxide. The Lightness (L reading) of the clean tile was determined using a spectrophotometer. Five readings were taken for each tile—one from each corner and the middle of the tile. The black soil was applied to the backside of four tiles for each test formula using a sponge. Likewise, the red soil was applied to the backside of four tiles for each test formula using a sponge. The black-soiled tiles were placed into a 120° F. oven for 20 minutes to dry and then removed from the oven and allowed to cool. Once the tiles were cool, the Lightness reading was taken again using a spectrophotometer and looking at each of the four corners and the middle of each tile. The red-soiled tiles were allowed to dry overnight at ambient temperature before being measured.

Once the tiles were measured, two tiles were placed in the center of a Gardner Abrasion Test tray (commercially available from Gardner) with the soiled side up and the grooves running horizontal. Two pieces of double-sided tape were cut into 1 inch pieces and placed under the sponge holder. 180-200 grams of the test solution were poured into the test tray so as to cover the tiles. For the black soiled tiles, the solution was allowed to sit for 2 minutes before testing and for the red soiled tiles, the solution was allowed to sit for 1 minute before testing. After the tiles had soaked for a period of time, the tray was placed onto the Gardner Abrasion Tester and the machine was started. For the black soiled tiles, the sponge was allowed to move across the tiles for 10 passes (1 cycle). For the red soiled tiles, the sponge was allowed to move across the tiles for 4 passes. Back and forth equals one pass. Once a cycle was completed, the machine was stopped, the tiles rotated 90 degrees, and the machine made an additional 10 or 4 passes. This was repeated four times. Once the test was completed, the tiles were removed from the machine and rinsed under cold water at low pressure. The tiles were then allowed to dry at an angle overnight. After drying, the tiles were tested again using a spectrophotometer with measurements taken in the four corners and the middle. The results from the test are shown in Table 1.

TABLE 1

| Formula 1 (Use Solution) | Kadet Quarry Tile Floor Cleaner (Use Solution) |
|---|---|
| Red Soil | |
| 57.23 | 57.51 |
| 58.24 | 59.09 |
| 60.82 | 61.98 |
| 58.43 | 62.13 |
| Average = 58.68 | Average = 60.18 |
| Black Soil | |
| 55.13 | 55.68 |
| 48.78 | 55.36 |
| 49.66 | 47.19 |
| 54.40 | 49.42 |
| Average = 51.99 | Average = 51.91 |

The results show that experimental Formula 1 removed approximately the same amount of soil as a commercially available product under conditions designed to simulate mopping action.

Example 4

Example 4 determined the cleaning efficacy of Formula 1 in Table B and Kadet Quarry Tile Floor Cleaner (commercially available from Ecolab Inc.) on quarry tile soiled with non-trans fat shortening. Six 2×4 inch quarry tile coupons were prepared for each formula. Six coupons were soiled with the red soil discussed in Example 3. The coupons were weighed and the weight recorded. The coupons were placed into a tray and 150 ml of solution was poured into the tray so as to cover the coupons. The coupons were allowed to sit in the solution for 10 minutes. The coupons were dipped into a beaker of water without using agitation for 2 seconds. Excess water was allowed to drip off of the coupon and the coupon was allowed to fully dry overnight. Once dry, the coupons were reweighed. The residual soil weight was calculated by taking the final substrate weight after being clean minus the initial substrate weight. Then the percent soil removal was calculated using the following:

100−[[residual soil weight (g)]/(starting soil weight (g)×100)]

where the starting soil weight in grams was determined by weighing clean tile and weight the tile with the soil on it and the calculating the difference between the weight of the soiled tile and the clean tile. The results are shown in Table 2.

TABLE 2

| 2 × 4 Quarry Tile Number | Tile Weight | Soil Wt. 0.06 (0.05 ± 0.0050) | 1 L water temp (80 ± 2) | Soil + Tile | Final Wt | Difference | % Soil Removal | Average |
|---|---|---|---|---|---|---|---|---|
| Control | 136.6167 | 0.0535 | 78 | 136.6702 | 136.6176 | 0.0009 | 98.32 | |
| Control | 137.0852 | 0.0548 | 78 | 137.14 | 137.0922 | 0.007 | 87.23 | |
| Control | 137.0852 | 0.0548 | 78 | 137.14 | 137.0922 | 0.007 | 87.23 | |
| Control | 136.6167 | 0.0535 | 78 | 136.6702 | 136.6176 | 0.0009 | 98.32 | |
| Control | 137.0852 | 0.0548 | 78 | 137.14 | 137.0922 | 0.007 | 87.23 | |
| Control | 137.0852 | 0.0548 | 78 | 137.14 | 137.0922 | 0.007 | 87.23 | 90.92667 |
| Formula 1 | 141.3939 | 0.0518 | 78 | 141.4457 | 141.395 | 0.0011 | 97.88 | |
| Formula 1 | 137.9521 | 0.0535 | 78 | 138.0056 | 137.9578 | 0.0057 | 89.35 | |
| Formula 1 | 137.9521 | 0.0535 | 78 | 138.0056 | 137.9578 | 0.0057 | 89.35 | |
| Formula 1 | 141.3939 | 0.0518 | 78 | 141.4457 | 141.395 | 0.0011 | 97.88 | |
| Formula 1 | 137.9521 | 0.0535 | 78 | 138.0056 | 137.9578 | 0.0057 | 89.35 | |
| Formula 1 | 137.9521 | 0.0535 | 78 | 138.0056 | 137.9578 | 0.0057 | 89.35 | 92.19333 |

Table 2 shows that there is no significant difference in cleaning efficacy between the experimental Formula 1 and a commercially available formula (control).

Example 5

Example 5 determined the effect of the floor cleaners on the coefficient of friction of an area of quarry tile flooring. For this example, a 10×8 foot tile section of six inch quarry tile was sectioned off in a quick service restaurant for testing. A 5×8 foot section was cleaned with a Kadet Quarry Tile Floor Cleaner (commercially available from Ecolab Inc.) use solution diluted to 0.5 ounces per gallon and a 5×8 foot section was cleaned with a use solution of 0.5 ounces per gallon of water of Formula 1 in Table B and allowed to dry. The coefficient of friction was measured with a BOT COF instrument, commercially available from Regan Scientific or Universal Walkway Testing LP. Measurements were taken before the floor was cleaned and after it was cleaned, and then the delta was calculated. The results are shown in Table 3.

TABLE 3

| | Control-Kadet Quarry Tile Floor Cleaner | | | Formula 1 | | |
|---|---|---|---|---|---|---|
| Reading | As is | Clean | Delta Change | As is | Clean | Delta Change |
| 1 | 0.4 | 0.43 | 0.03 | 0.37 | 0.37 | 0.00 |
| 2 | 0.42 | 0.41 | −0.01 | 0.38 | 0.38 | −0.01 |
| 3 | 0.4 | 0.42 | 0.02 | 0.4 | 0.4 | 0.00 |
| 4 | 0.42 | 0.41 | −0.01 | 0.43 | 0.43 | 0.03 |
| 5 | 0.45 | 0.44 | −0.01 | 0.44 | 0.44 | 0.04 |
| 6 | 0.43 | 0.44 | 0.01 | 0.46 | 0.46 | 0.06 |
| 7 | 0.47 | 0.47 | 0.00 | 0.55 | 0.55 | 0.12 |
| 8 | 0.43 | 0.48 | 0.05 | 0.57 | 0.57 | 0.14 |
| 9 | 0.48 | 0.48 | 0.00 | 0.51 | 0.51 | 0.10 |
| Average | 0.43 | 0.44 | 0.01 | 0.4 | 0.46 | 0.05 |
| % Change | | | 2% | | | 13% |

Table 3 shows that Formula 1 was found to improve the coefficient of friction compared to the commercial formula (control formula) with a 13% improvement compared to control.

Example 6

Example 6 determined the effect of propylene glycol on viscosity. For this example the following concentrated formulations were prepared.

| | Formula 3 | Formula 4 | Formula 5 | Formula 6 | Formula 7 |
|---|---|---|---|---|---|
| Water Zeolite Softened | 27.6 | 24.7 | 23.6 | 21.2 | 19.2 |
| Triethanolamine 99% | 9.5 | 9.5 | 9.5 | 9.5 | 9.5 |
| NaOH 50 Percent Liquid | 3.3 | 3.3 | 3.3 | 3.3 | 3.3 |
| Alcohol Ethoxylate-Tomadol 1-7,Neodol | 5.8 | 5.8 | 5.8 | 5.8 | 5.8 |
| Propylene Glycol Technical | 1.2 | 4.2 | 5.2 | 7.7 | 9.7 |
| Dodecyl Benz Sulfonic Acid 96% | 30.0 | 30.0 | 30.0 | 30.0 | 30.0 |
| CITRIC ACID, 50% | 18.0 | 18.0 | 18.0 | 18.0 | 18.0 |
| Sodium Xylene Sulfonate 40% | 4.5 | 4.5 | 4.5 | 4.5 | 4.5 |
| Herbal Fragrance | 0.1 | 0.1 | 0.1 | 0.1 | 0.1 |
| Dye Bright Green LX-6545 | 0.0012 | 0.0012 | 0.0012 | 0.0012 | 0.0012 |

The viscosity of each concentrate formulation (undiluted) was measured using a Brookfield viscometer with a Spindle #21 at 20 RPMs at a temperature of 72° F. Table 4 shows that the viscosity decreases as the concentration of propylene glycol increases.

TABLE 4

| | Viscosity | % Propylene Glycol |
|---|---|---|
| Formula 3 | 890 | 1.2 |
| Formula 4 | 687.5 | 4.2 |
| Formula 5 | 595 | 5.2 |
| Formula 6 | 435 | 7.7 |
| Formula 7 | 300 | 9.7 |

Example 7

Example 7 determined the coefficient of friction (COF) of tiles soiled with spent shortening from Chikfil-A. For this test, 0.3 grams of shortening was applied to a quarry tile. Once soil was applied to the quarry tile, measurements were taken using the Brungraber Mark II and Neolite sensor. These measurements were used as the soiled readings. 3 ml of product diluted according to the directions (or water) was added to the soiled area. The tiles were allowed to sit in the use solution for a 2 minute dwell time. Formula 8 was diluted to 0.5 ounces per gallon of water. The Kadet Quarry Tile Floor Cleaner was also diluted to 0.5 ounces per gallon of water. After 2 minutes, the tiles were tilted vertically so the solution was allowed to run off. Then, the tiles were blotted with paper towel and allow to air dry for 1.5 hours. Once the tiles were dried, they were measured again with the Brungraber to measure the soil remaining on the tile and to calculate the soil removal. Soil removal is based off of the change in COF—the higher the change the better the cleaning. For this test, Formula 8 was compared to a water control and to the Kadet Quarry Tile Floor Cleaner, commercially available from Ecolab Inc. The results are shown in Table 5.

| Formula 8 | |
|---|---|
| Water | 69.08786 |
| Sodium Chloride | 1 |
| Sodium Lauryl Ethoxylate Sulfate 60% | 2.1 |
| Dodecyl Benzene Sulfonic Acid 96% | 10.15009 |
| Citric Acid, 50% | 11.510253 |
| Triethanolamine 99% | 4.58874 |
| NaOH 50% Liquid | 1.49424 |
| Fragrance | 0.068 |
| Dye | 0.000816 |

TABLE 5

| Solution | Initial COF | Soiled COF | Clean COF | Change COF | Avg. Change COF |
|---|---|---|---|---|---|
| Water | 0.68 | 0.2 | 0.34 | 0.14 | 0.15 |
| Water | 0.69 | 0.2 | 0.3 | 0.1 | |
| Water | 0.7 | 0.2 | 0.4 | 0.2 | |
| Formula 8 | 0.72 | 0.2 | 0.56 | 0.36 | 0.36 |
| Formula 8 | 0.71 | 0.2 | 0.56 | 0.36 | |
| Formula 8 | 0.72 | 0.2 | 0.56 | 0.36 | |
| Kadet Quarry Tile Floor Cleaner | 0.7 | 0.2 | 0.48 | 0.28 | 0.26 |
| Kadet Quarry Tile Floor Cleaner | 0.68 | 0.2 | 0.45 | 0.25 | |
| Kadet Quarry Tile Floor Cleaner | 0.7 | 0.2 | 0.46 | 0.26 | |

Table 5 shows that Formula 8 decreased the COF more than the water control or the commercially available Kadet Quarry Tile Floor Cleaner. This indicates that Formula 8 would be the most effective at making floors less slippery.

Example 8

Example 8 determined the gloss caused by polymerized soil on tiles. For this example, quarry tiles were collected from a quick service restaurant. These quarry tiles had built-up polymerized soil from shortening on them. Three drops of diluted cleaning solution was applied to each tile using a pipette. The solution was allowed to remain on the tile for approximately 1.5 hours, or until dry. After 1.5 hours, the tiles were rinsed and blotted with a paper towel. This process of applying solution, waiting for 1.5 hours, and then rinsing and drying was repeated three times. Gloss readings were taken of the tiles, before and after cleaning, using a BTC Colorimeter. The soil removal was based on the decrease in gloss—the lower the reading the better the cleaning.

This example compared experimental formulations 8, 9 and 10 to three commercially available formulations: Kadet Quarry Tile Floor Cleaner, QSR Quarry Tile Floor Cleaner, and Kay Solidsense Floorcare A, each of which are commercially available from Ecolab Inc. The QSR Quarry Tile Floor Cleaner, the Kadet Quarry Tile Floor Cleaner, and Formulas 8, 9 and 10 were diluted to 0.5 ounces per gallon of water. The Kay Solidsense Floorcare A formulation was diluted to 0.2 ounces per gallon. An untreated tile was also measured. The results are shown in Table 6.

| | Formula 9 | Formula 10 |
|---|---|---|
| Water Zeolite Softened | 73.2 | 68.8 |
| Dodecyl Benzene Sulfonic Acid 96% | 9.3 | 9.7 |
| Citric Acid, 50% | 7.4 | 11 |
| Triethanolamine 99% | 4.2 | 4.4 |
| NaOH 50% | 1.4 | 1.4 |
| Alcohol Ethoxylate | 1.9 | 2.0 |
| Propylene Glycol | 0.5 | 0.6 |
| Sodium Xylene Sulfonate 40% | 2.0 | 2.0 |
| Herbal Fragrance | 0.07 | 0.07 |
| Dye Bright Green LX-6545 | 0.0008 | 0.0012 |

TABLE 6

| Formula | After Cleaned 3 Times |
|---|---|
| QSR Quarry Tile Floor Cleaner | 3.2 |
| QSR Quarry Tile Floor Cleaner | 2.8 |
| QSR Quarry Tile Floor Cleaner | 2.6 |
| Formula 9 | 4 |
| Formula 9 | 4 |
| Formula 9 | 3.7 |
| Untreated Tile | 5 |
| Untreated Tile | 5 |
| Untreated Tile | 4.7 |
| Kadet Quarry Tile Floor Cleaner | 2.8 |
| Kadet Quarry Tile Floor Cleaner | 3 |
| Kadet Quarry Tile Floor Cleaner | 3 |
| Kay Solidsense Floorcare A | 2.9 |
| Kay Solidsense Floorcare A | 2.8 |
| Kay Solidsense Floorcare A | 2.9 |
| Formula 10 | 2.8 |
| Formula 10 | 2.6 |
| Formula 10 | 2.4 |
| Formula 10 | 2.3 |
| Formula 8 | 1.4 |
| Formula 8 | 1.5 |
| Formula 8 | 2 |
| Formula 8 | 1.2 |
| Formula 8 | 1.4 |
| Formula 8 | 2.2 |

Table 6 shows that Formula 8 was the most effective at removing the polymerized soil and even more effective than the commercially available formulations. Table 6 also shows that Formula 10 was at least as effective as the commercially available products at removing the polymerized soil. Formula 9 contained the most water of Formulas 8, 9, and 10 and did not perform as well. This suggests that the more concentrated formulations are better at removing the polymerized soils.

The above specification provides a complete description of the disclosed compositions and methods. Since many embodiments can be made without departing from the spirit and scope of the invention, the invention resides in the claims.

We claim:

1. A method of cleaning floors comprising:

(A) forming a use solution by mixing water and from about 1 to about 0.5 ounces per gallon of water of a concentrated acidic cleaner, the concentrated acidic cleaner consisting of:

(i) from about 1 to 60 wt.% of acid selected from the group consisting of citric, isocitric, tartaric, malic, monohydroxyacetic, acetic, gluconic and salts and mixtures thereof;

(ii) from about 0 to about 80 wt.% of a buffering salt;

(iii) from about 0 to about 40 wt.% of a surfactant;

(iv) amine; and (v) caustic wherein the concentrated acidic cleaner has ratio of total acid to free acid of at least 2.5:1 and (B) applying the use solution to a floor.

2. The method of claim 1, wherein the use solution has a pH from about 1 to about 6.

3. The method of claim 1, wherein the free amine is less than 0.1 wt.%.

4. The method of claim 1, wherein the acid has a pK value greater than 2.8.

5. The method of claim 1, wherein the use solution is applied to the floor daily.

6. The method of claim 1, wherein the concentrated acidic cleaner consists of:

(i) from about 1 to 60 wt.% of acid selected from the group consisting of citric, isocitric, malic, acetic, and gluconic acid;

(ii) from about 0.25 to about 6 wt.% of a buffering salt;

(iii) from about 0.25 to about 6 wt.% of a surfactant;

(iv) amine; and (v) caustic, wherein the concentrated acidic cleaner has ratio of total acid to free acid of at least 2.5:1.

7. The method of claim 6, wherein the cleaner has low irritation to eyes and skin.

8. A method of cleaning floors comprising:

(A) forming a use solution by mixing water and from about 0.1 to about 1 ounces per gallon of water of a concentrated acidic cleaner, the concentrated acidic cleaner consisting of:

one or more acids selected from the group consisting of citric, isocitric, malic, acetic, sulfamic, and gluconic acids and salts and mixtures thereof, wherein the concentrated acidic cleaner comprises from about 1 to 60 wt.% of acid;

(ii) from about 0.25 to about 6 wt.% of a buffering salt;

(iii) from about 0.25 to about 6 wt.% of a surfactant;

(iv) thickener;

(v) amine;

(vi) caustic;

(vii) water; and (viii) from about 0 to about 10 wt. % of a hydrotrope;

wherein the concentrated acidic cleaner has ratio of total acid to free acid of at least 2.5:1; and (B) applying the use solution to a floor.

9. The method of claim 8, wherein the acids are selected such that the cleaner has low irritation to eyes and skin.

10. The method of claim 8, wherein the hydrotrope is selected from the group consisting of sodium alkylnaphthalene sulfonate, sodium xylene sulfonate, and mixtures thereof.

11. The method of claim 8, wherein the concentrated acidic cleaner has a viscosity of about 125 to about 600 centipoise.

12. The method of claim 8, wherein the acids consist of a first acid and a second acid, and wherein the first acid is citric acid and wherein the second acid is sulfamic acid.

13. The method of claim 8, wherein the concentrated acidic cleaner comprises 0.1 wt.% or less free amine.

14. The method of claim 8, wherein the use solution comprises from about 0.1 to about 0.5 ounces of the concentrated acidic cleaner per gallon of water.

15. The method of claim 8, wherein the use solution comprises from about 0.25 to about 0.5 ounces of the concentrated acidic cleaner per gallon of water.

* * * * *